US007469522B2

(12) United States Patent
Dettwiller

(10) Patent No.: US 7,469,522 B2
(45) Date of Patent: Dec. 30, 2008

(54) FLEXIBLE CONTAINER FORMING AND FILLING APPARATUS

(75) Inventor: Christian Dettwiller, Soucht (FR)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 11/400,013

(22) Filed: Apr. 8, 2006

(65) Prior Publication Data

US 2007/0234685 A1 Oct. 11, 2007

(51) Int. Cl.
*B65B 1/02* (2006.01)

(52) U.S. Cl. ..... 53/558; 53/452; 53/459; 53/133.1; 53/570

(58) Field of Classification Search ..... 53/452, 53/459, 558, 133.1, 133.2, 570, 249
See application file for complete search history.

(56) References Cited

U.S. PATENT DOCUMENTS

| | | | | |
|---|---|---|---|---|
| 3,580,298 | A | 5/1971 | Trusselle | |
| 3,868,891 | A * | 3/1975 | Parish | 493/194 |
| 5,086,609 | A | 2/1992 | Tetenborg | |
| 6,220,807 | B1 * | 4/2001 | Sorokan | 414/22.62 |
| 2003/0085582 | A1 * | 5/2003 | Woodruff et al. | 294/103.1 |
| 2004/0005978 | A1 | 1/2004 | Ammons et al. | |
| 2005/0129885 | A1 | 6/2005 | Mize | |

FOREIGN PATENT DOCUMENTS

| | | | |
|---|---|---|---|
| FR | 2882027 | * | 1/2006 |
| FR | 2882028 | * | 1/2006 |

* cited by examiner

*Primary Examiner*—Hemant M Desai
(74) *Attorney, Agent, or Firm*—Jovan N. Jovanovic; Vladan M. Vasiljevic; The Watson I.P. Group, PLC

(57) ABSTRACT

A flexible container forming and filling apparatus comprising a flexible container forming assembly, a flexible container filling assembly and a transfer assembly. The flexible container forming assembly is configured for forming at least two side by side flexible containers which define at least a first output and a second output. The flexible container filling assembly is associated with the flexible container forming assembly and has a receiving region configured for receipt of sequential flexible containers for filling. The transfer assembly is configured for sequentially transferring flexible containers from the first output to the receiving region of the flexible container filling assembly and from the second output to the receiving region of the flexible container filling assembly.

11 Claims, 9 Drawing Sheets

12
14
16
70
72
78a
78b
206a
206b
210
A
B
C
D
D'
1
2
3
4

FLEXIBLE CONTAINER FORMING AND FILLING APPARATUS

BACKGROUND OF THE INVENTION

1. Field of the Invention

The present invention relates to container forming and filling devices which are capable of forming, sealing and filling flexible containers, and, more particularly, to a container forming and filling device which includes a transfer assembly for transferring multiple streams of flexible containers formed side by side to a filling device.

2. Background Art

Generally, the filling of bag in box flexible containers requires three distinct steps. First a flexible container is formed on a first piece of equipment. The formed flexible container is then generally transferred, shipped or otherwise delivered to a filler wherein the formed flexible container is introduced into a second piece of equipment and filled with a particular desired flowable material. Finally, the filled flexible container is then placed into an outer flexible container, typically, a paperboard box.

One drawback to such production is that the flexible container formation equipment is located at a first installation and the filling equipment is located at a second installation. Thus, after formation, the flexible containers must be packaged and shipped to the filling location. The handling and shipping of the formed flexible containers introduces a number of disadvantages. In addition to the inherent disadvantage relative to speed and efficiency, the handling of the bag between the first and second installation results in the compromising of a certain percentage of the flexible containers and, ultimately, to failure of these flexible containers after filling.

As such, there is an inherent advantage that is realized when flexible container formation and flexible container filling is combined into a single installation such that a particular piece of equipment begins with a plurality of rolls of film at the input side and a filled flexible container placed into an outer box at the other side. Such equipment is generally referred to as Form, Seal, Fill equipment, or FSF. More specifically, webs of film are provided to the equipment. The webs of film are formed and a flexible container cavity is made in a sealing step. Finally, the fully made flexible container is filled by a fill head.

In such an operation, the handling of the flexible containers between formation and shipment is minimized. Thus, efficiency gains are experienced. Moreover, the flexible containers encounter a minimal handling thereof. As a result, failures and compromised flexible containers are virtually eliminated.

While the advantages of form, seal and fill equipment has been noted, there has been some difficulty in realizing the full potential of such a system. One particular difficulty has resulted from inherent differences in production between forming and sealing equipment relative to the filling equipment. As the filling step can usually be processed at a quicker rate, the filling equipment must be throttled down so that the two assemblies can operate in unison.

Accordingly, it would be desirable to form multiple flexible containers in forming and sealing equipment for feeding to a single filling machine such that the speed advantages of the filling equipment can be realized and exploited.

It is another object of the invention to form multiple flexible containers simultaneously in a single forming assembly for feeding into a single filling machine such that the advantages of the filling equipment can be realized while not requiring a plurality of forming and sealing equipment.

These and other objects of the invention will become apparent in light of the specification and claims appended hereto.

SUMMARY OF THE INVENTION

The invention comprises a flexible container forming and filling apparatus comprising a flexible container forming assembly, a flexible container filling assembly and a transfer assembly. The flexible container forming assembly is configured for forming at least two side by side flexible containers which define at least a first output and a second output. The flexible container filling assembly is associated with the flexible container forming assembly and has a receiving region configured for receipt of sequential flexible containers for filling. The transfer assembly is configured for sequentially transferring flexible containers from the first output to the receiving region of the flexible container filling assembly and from the second output to the receiving region of the flexible container filling assembly.

In a preferred embodiment, the transfer assembly comprises a first arm and a second arm. The first arm pivots about a first pivot axis. The second arm pivots about a second pivot axis. The first arm includes a first end, a second end, and, a first container grasping assembly associated with the second end of the first arm. The second arm pivots includes a first end, a second end, and a second container grasping assembly associated with the second end of the second arm. The first arm pivots between a first position corresponding to the first output and a second position corresponding to the receiving region and the second arm pivots between a first position corresponding to the second output and a second position corresponding to the receiving region.

In another preferred embodiment, the transfer assembly is configured for releasably retaining at least one of a spout, a closure member and a flexible bag of a flexible container.

In yet another preferred embodiment, at least one of the first container grasping assembly and the second container grasping assembly comprises a first jaw and a second jaw. The first jaw has a first spout receiving region. The second jaw has a second spout receiving region. The second jaw pivots about a pivot axis and including means for pivoting the second jaw about the pivot axis. In yet another preferred embodiment, the first container grasping assembly and the second container grasping assembly each comprise such a structure.

In yet another preferred embodiment, the first pivot axis is spaced apart from the second pivot axis. In other embodiments they may be the same.

In yet another preferred embodiment, at least one of the first arm and the second arm comprises a first member and a second member wherein the respective container grasping assembly is coupled to the second member and wherein the second member is at least one of slidably and rotatably coupled to the first member.

In one such embodiment, each of the first arm and the second arm include a first member and a second member. Additionally, the first pivot axis and the second pivot axis may comprise the same pivot axis.

In yet another preferred embodiment, the first pivot axis is spaced apart from the second pivot axis.

In another aspect of the invention, the transfer assembly comprises a first arm having a first member and a second member. The container grasping assembly is associated with the second member. The first and second members are at least one of slidably and rotatably coupled to the first member. The container grasping assembly is positionable between the first output and the receiving region and the second output and the receiving region.

In a preferred embodiment, the container grasping assembly comprises a first jaw assembly and a second jaw assembly. The first jaw assembly has a first spout receiving region. The second jaw assembly has a second spout receiving region. The second jaw assembly pivots about a pivot axis and includes means for pivoting the second jaw about the pivot axis.

In a preferred embodiment, the flexible container forming assembly further comprises a film supply subassembly, a spout attachment assembly positioned downstream of the film supply subassembly, a flexible container sealing assembly positioned downstream of the spout attachment assembly, and a cutting assembly positioned downstream of the film supply subassembly.

In a preferred embodiment, the flexible container filling assembly comprises a rotary filler.

In another aspect of the invention, the invention comprises a transfer assembly configured for sequentially transferring flexible containers from a first output of a flexible container forming assembly to a receiving region of a flexible container filling assembly and from a second output to the receiving region of the flexible container filling assembly. In particular, the transfer assembly includes a first arm pivoting about a first pivot axis and a second arm pivoting about a second pivot axis. The first arm includes a first end, a second end, and, a first container grasping assembly associated with the second end of the first arm. The second arm includes a first end, a second end, and a second container grasping assembly associated with the second end of the second arm.

In a preferred embodiment, at least one of the first arm and the second arm comprises a first member and a second member. The respective container grasping assembly is coupled to the second member. The second member is at least one of slidably and rotatably coupled to the first member.

In another preferred embodiment, the first pivot axis is spaced apart from the second pivot axis. In another preferred embodiment, the first pivot axis and the second pivot axis comprise the same pivot axis.

In another aspect of the invention, the invention comprises a transfer assembly which comprises a first arm having a first member and a second member. A container grasping assembly is associated with the second member. The first and second members are at least one of slidably and rotatably coupled to the first member. The container grasping assembly is positionable between the first output and the receiving region and the second output and the receiving region.

The invention further comprises a method of transferring a flexible container from a flexible container forming assembly to a flexible container filling assembly comprising the steps of: providing a first flexible container at a first output of a flexible container forming assembly; providing a second flexible container at a second output of a flexible container forming assembly; and sequentially transferring the first flexible container and the second flexible container to a receiving region of a flexible container filling assembly.

In a preferred embodiment of the method, the step of sequentially transferring comprises the steps of grasping the first container with a first container grasping assembly at the first output; grasping the second container with a second container grasping assembly at the second output; moving the first container grasping assembly to the receiving region of the flexible container filling assembly; and pivoting the second container grasping assembly to the receiving region of the flexible container filling assembly.

In another preferred embodiment of the method, the step of sequentially transferring comprises the steps of grasping the first container with a first container grasping assembly; pivoting the first container from the first output to the receiving region of the flexible container filling assembly; grasping the second container with the first container grasping assembly; and pivoting the second container from the second output to the receiving region of the flexible container filling assembly.

BRIEF DESCRIPTION OF THE DRAWINGS

The invention will now be described with reference to the drawings wherein.

DETAILED DESCRIPTION OF THE INVENTION

Figure 1:
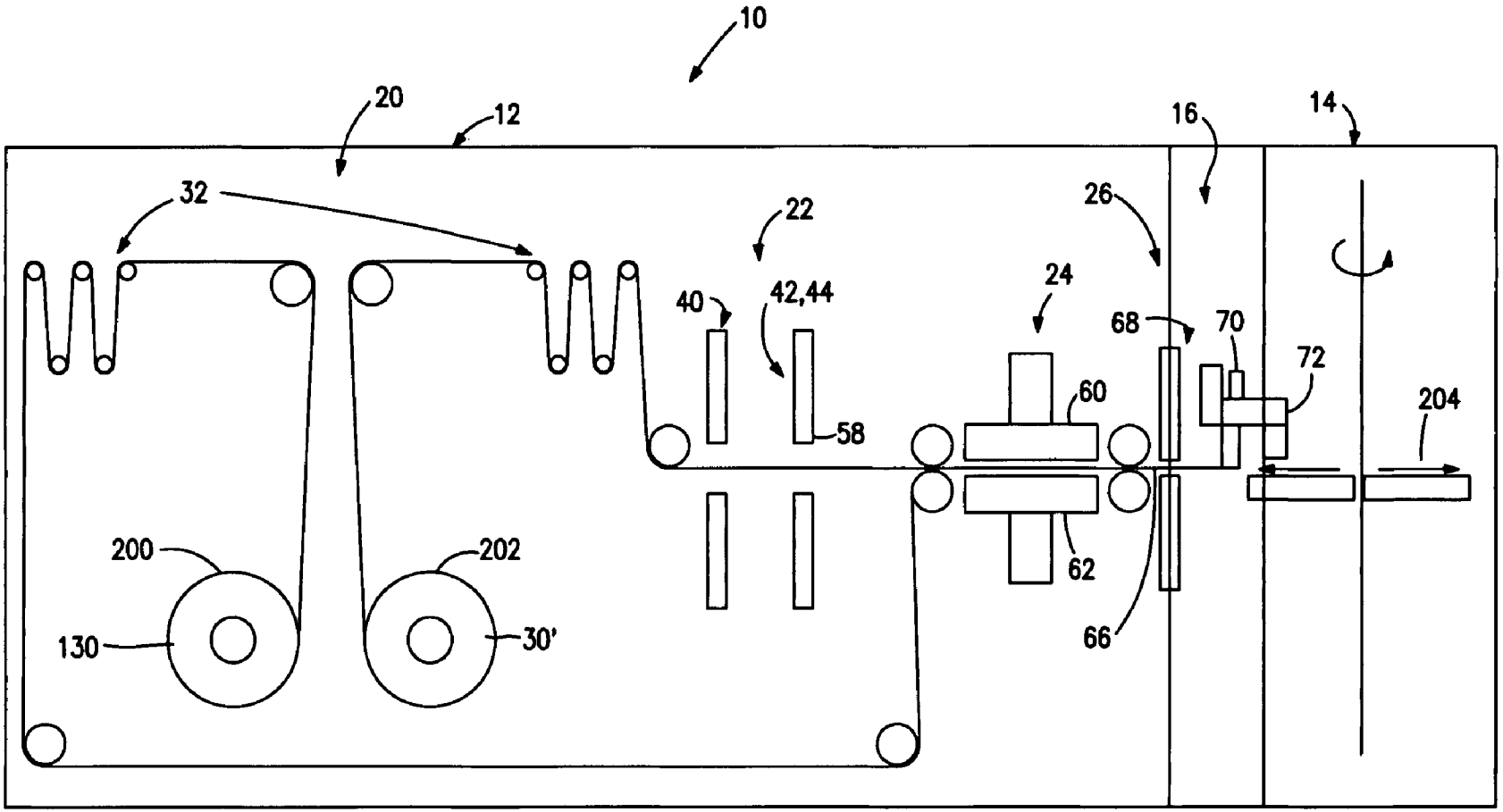
FIG. 1 of the drawings comprises a schematic side elevational view of the flexible container forming and filling apparatus of the present invention.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the flexible container forming and filling apparatus is shown generally at 10 (the apparatus). Such an apparatus comprises flexible container forming assembly 12, a flexible container filling assembly 14 and a flexible container transfer assembly 16. The particular equipment is positioned in-line such that the input into the equipment is a web of film (such as webs 200, 202) and the output of the equipment is a filled flexible container (such as filled flexible container 204). The apparatus is configured for formation and filling of a number of differently sized flexible containers having spouts thereon. For example, it is contemplated that the flexible containers may have a volume of between 1 and 10 liters. However, the invention is not limited to any particular size or shape of flexible containers.

Furthermore, the filling assembly may transfer any number of different flowable materials into the formed flexible containers. Typically, the different flowable materials may comprise liquids, such as juices and industrial chemicals, as well as thicker fluids, such as syrups, oils and/or lotions. Of course, the invention is not limited to any particular type of flowable materials, and, it will be understood that the invention can be utilized with any material which can be handled properly by filling equipment.

Figure 3:
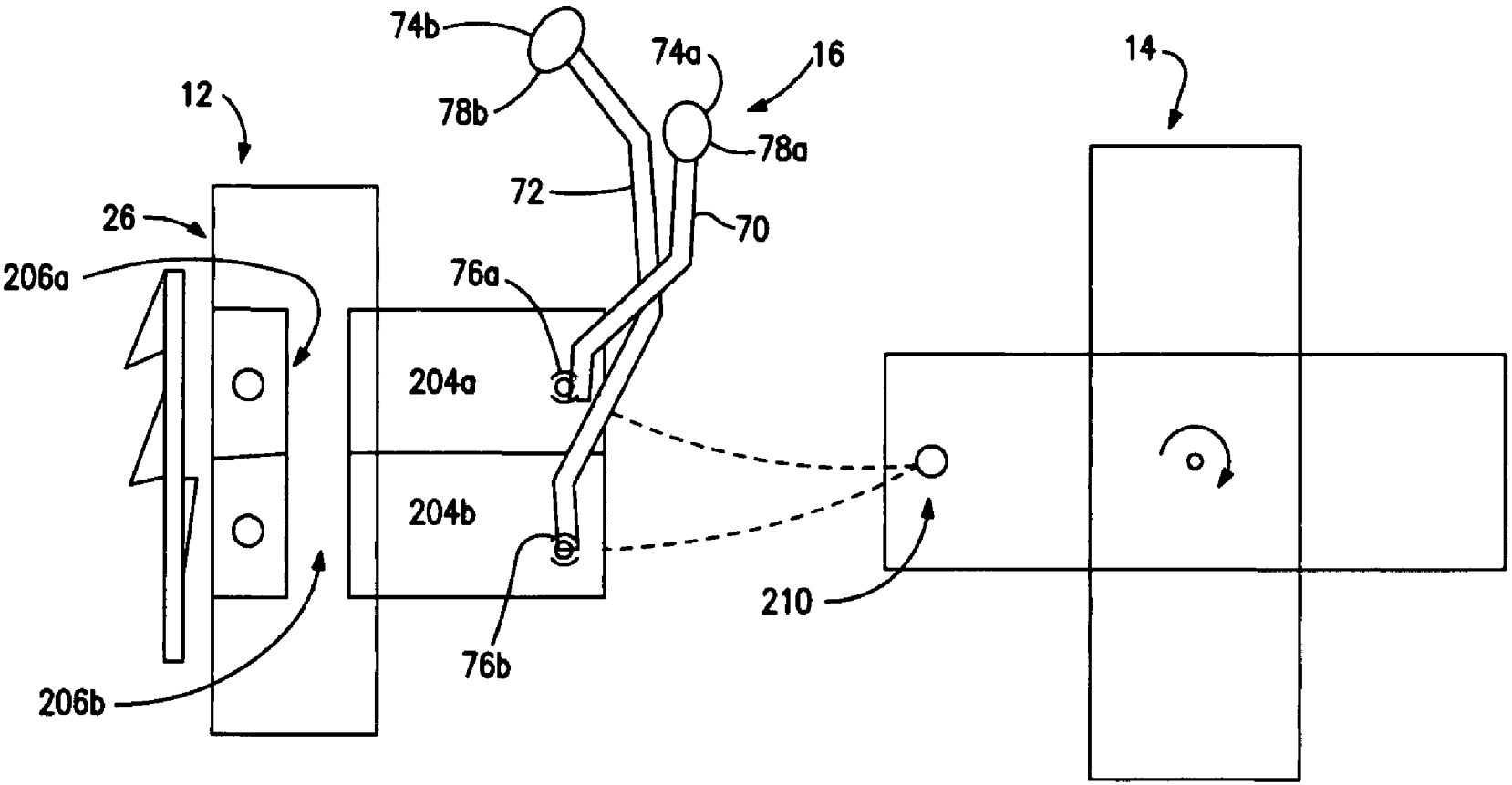
FIG. 3 of the drawings comprises a schematic representation of a partial top plan view of the transfer assembly of the present invention showing the movement of the first and second arms between the bag forming assembly and the bag filling assembly.

Container forming assembly 12 comprises film supply subassembly 20, spout attachment assembly 22, sealing assembly 24 and cutting assembly 26. With reference to FIG. 3, in the embodiment contemplated, the container forming assembly is configured to form two flexible containers in an identical side by side orientation. In other embodiments, it is contemplated that a greater number of flexible containers may be formed in a side by side orientation (identical, staggered or otherwise). The film supply subassembly 20 comprises at least two rollers, such as roller 30, 30', and means 32 for guiding film. In the embodiment shown, two rollers are utilized inasmuch as the flexible container that is to be formed includes a bag having single ply pillow type construction a spout and a closure member. In such an embodiment, one roller holds the first film web which forms the first wall of the pillow type container and the second roller holds the second film web which forms the second wall of the pillow type container. Of course, in other embodiments, multiple rollers may be utilized so as to form, for example, multi-ply flexible containers.

Rollers 30, 30' comprise powered rollers which are capable of rotating at a predetermined rate. The roller speed is controlled by, for example, a stepper motor or the like, such that the linear speed of the film as the film proceeds from the powered rollers is strictly controlled. The rollers include outwardly extendible clamps which apply a biasing means against the web roll, to, in turn, preclude relative movement of the web vis-à-vis the roller.

The guiding means 32 comprises a plurality of rollers and guides. The guiding means insures proper transverse orientation of the web relative to each of the assemblies. Furthermore, the guiding means insures the proper desired tension on the web as it proceeds through the apparatus. The rollers, combined with sensors insure the lateral position of the web as well as the transverse speed of the film proceeding through the entire assembly. Control systems may be incorporated into the guiding means to allow for constant monitoring and automated adjustment of the web during operation of the apparatus.

Spout attachment assembly 22 is shown in FIG. 1 as comprising film spout opening cutting assembly 40, spout handling and positioning assembly 42 and spout sealing assembly 44. It will be understood that the spout attachment assembly is configured to form the film spout opening, position the spout and attach the spout to the flexible container. In the embodiment shown, the spout attachment assembly 22 attaches two spouts (including pre-positioned closure members) to the film in a spaced apart orientation, inasmuch as two flexible containers are manufactured in a side by side orientation.

Film spout opening cutting assembly 40 comprises two cutting heads which are positioned in a spaced apart orientation and which form openings in the film at predetermined positions. The spout handling and positioning assemblies include a pair of jaws (not shown) which are configured to grasp, retain and release spouts as desired, as well as means for moving the jaws into an overlaying orientation relative to the film, so as to position the jaws (having the spout held therebetween) into a desired orientation.

Spout sealing assembly 44 comprises heating press 58 which is configured to seal the spout to the film. Of course, a number of different spout sealing assemblies are contemplated. In certain configurations, the spout may be sealed through RF sealing. In other embodiments the spout may be otherwise attached to the film. The invention is not limited to any particular sealing method or sealing structure.

Flexible container sealing assembly 24 is shown in FIG. 1 as comprising upper plate 60, lower plate 62. At least one of upper plate 60 and lower plate 62 includes a sealing pattern. One exemplary sealing pattern results in a rectangular flexible containers as is shown in FIG. 3. It will be understood that as the upper and lower plates are pressed together, the sealing pattern melts the separate layers of film so as to join the film and so as to define the cavities of the respective flexible containers. In the embodiment shown, two flexible containers are formed in a side by side orientation in the flexible container sealing assembly.

Cutting assembly 26 is shown in FIG. 1 as comprising longitudinal cutter 66 and transverse cutter 68. The longitudinal cutter is positioned between the two side by side formed flexible containers. As the web proceeds through the forming assembly, the longitudinal cutter separates the two side by side flexible containers, so as to create two separate webs. Transverse cutter 68 separates sequential flexible containers on each of the separated side by side webs. It will be understood that while the transverse cutter is shown as cutting the side by side flexible containers into two webs prior to the transverse cutter actuation to separate the formed flexible container from the immediate upstream flexible container, the transverse cutter may be upstream of the longitudinal cutter in certain embodiments. The finished flexible containers exit the flexible container forming assembly at first output 206*a* and second output 206*b* (FIG. 3). In certain embodiments the longitudinal cutter may be positioned proximate the rollers, to essentially split the web into two separate webs prior to formation. In other embodiments, four rollers or two rollers each having two rolls can be utilized which would eliminate the need for the longitudinal cutter.

The other end of the system comprises flexible container filling assembly 14. The flexible container filling assembly comprises a rotary filler. One such rotary filler configured for use with the present invention is shown and described in U.S. Pat. No. 6,786,252 issued to Erb et al, entitled "Machine for Filling Bags or the Like Comprising a Control Device with Cams," the entire specification of which is incorporated by reference. Of course, the present invention is not limited to such a rotary filler, and, other rotary fillers are contemplated for use, including, but not limited to, U.S. Pat. No. 6,655,109 issued to Resterhouse et al, entitled "Filler Device Sub-Assembly and Associated Method," the entire specification of which is incorporated by reference. Such rotary fillers, as well as other rotary fillers, include a plurality of stations which rotate about a central axis. Generally, such rotary fillers receive a flexible container at each station sequentially. As the rotary filler rotates, the flexible container is uncapped, filled and recapped. Finally, it is released from the rotary filler and positioned into another container (such as a corrugated box) or onto a conveyor.

As set forth in the foregoing incorporated disclosures, the filling stations of any such rotary filler are configured to receive a flexible container at a particular receiving region during the rotation process, fill the flexible container, and release the flexible container at another predetermined region. Such a cycle continues as the filling stations rotate about the central axis. With such filler devices, the spout is received and retained by jaws associated with the filler station. In certain embodiments, the flexible container is received with a closure member pre-positioned over the spout, wherein the filler device retains the spout within jaws, while uncapping the closure member therefrom for filling. Once filled, the closure member is replaced onto the spout. Once the flexible container is filled and capped, the flexible container is removed from the filler device. In many embodiments, the filled flexible container is placed into an outside box for shipment and sale.

In the present apparatus, a transfer assembly 16 couples flexible container forming assembly 12 with flexible container filling assembly 14, so as to transfer any flexible containers formed in the flexible container forming assembly to the flexible container filling assembly and disposing same at first output 206*a* and second output 206*b* (FIG. 3). As will be explained below, the flexible containers 204*a*, 204*b*, which were produced, are sequentially introduced into the flexible container filling assembly and captured by the flexible container filling assembly at generally the same receiving region, namely receiving region 210. Generally, the receiving region 210 is defined by a relatively small region in which sequential filler heads and filler stations are ready to receive and retain a flexible container. As such, the initiating points of each flexible container (the initial position of the flexible containers at each of first output 206*a* and second output 206*b*) are divergent when they are first grasped by the first and second arms. Flexible containers from the first output 206*a* and second output 206*b* are sequentially transferred to the filler device at the convergent receiving region 210.

Figure 2:
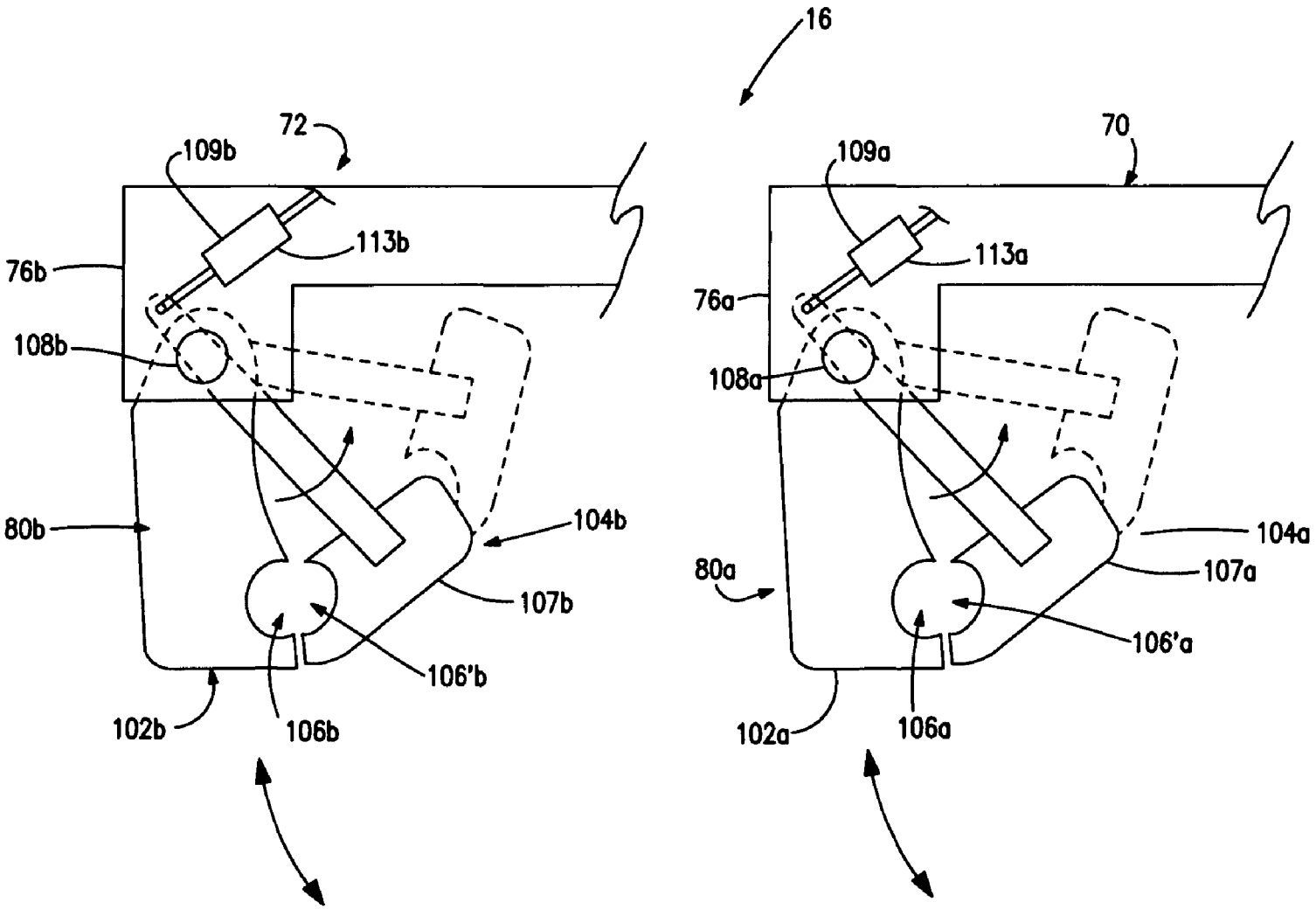
FIG. 2 of the drawings comprises a partial top plan view of the transfer assembly of the present invention showing the second end of each of the first and second arms.

One embodiment of transfer assembly 16 is shown in more detail in FIG. 2 and schematically in FIG. 3. To achieve the above-described operation, transfer assembly 16 includes first arm 70 and second arm 72. First arm 70 includes first end 74*a* and second end 76*a*. First end 74*a* includes first arm pivot axis 78*a*. First arm pivot axis 78*a* is substantially vertical. Second end 76*a* extends away from pivot axis 78*a* and includes container grasping assembly 80*a*.

In one embodiment, container grasping assembly 80*a* is shown in FIG. 2 as comprising first jaw 102*a* and second jaw assembly 104*a*. First jaw 102*a* is stationary relative to second end 76*a* of first arm 70. The first jaw 102*a* includes spout receiving region 106*a* which is configured in a shape mating configuration relative to a spout such that a portion of the spout (generally between flanges) can be readily accepted into the spout receiving region. In the embodiment shown, the spout receiving region of the first jaw is vertically offset from first arm 70 such that the first arm 70 is spaced away from the output of the flexible container forming assembly 12 and input of the flexible container filling assembly 14, to minimize interference therewith. In the present embodiment, the first jaw is positioned below the arm such that the arm is well above the output and input of the respective flexible container forming assembly and the flexible container filling assembly.

Second jaw assembly 104*a* includes second jaw 107*a* and means 109*a* for pivoting the second jaw relative to pivoting axis 108*a*. Second jaw 104*a* includes spout receiving region 106'*a* which is configured in a shape mating configuration relative to a spout. More specifically, second jaw 107*a* is rotatably coupled at pivoting axis 108*a*. Pivoting means 109*a*, in this embodiment, air cylinder 113*a*, is capable of rotating the second jaw relative to the pivoting axis 108*a* from a first position (represented by the phantom view of the second jaw) to a second position (represented by the solid representation of the second jaw). In a first position, the second jaw 107*a* is rotated away from first jaw 102*a*. In a second position, second jaw 107*a* is rotated toward first jaw 102*a* and positioned such that the spout receiving regions 106*a*, 106*a*' are in a position to releasably retain a spout therebetween. In the first position the second jaw 107*a* is rotated a distance sufficient so as to freely permit the passage of a spout between the first and second jaws. In the embodiment shown, the jaws are configured such that they grasp the sides of the spout relative to the direction of travel of the flexible container out of the flexible container forming assembly. It will be understood that in other embodiments, the grippers may both be movable. In certain embodiments, the jaws may be biased toward each other, wherein the spout must overcome the biasing so as to be received in the receiving region.

It will also be understood that in other embodiments, the container grasping assembly may grasp one of the a portion of the flexible bag, the spout and/or the closure member. For example, gripper arms or the like may be utilized to grasp a portion of the closure member (or a combination of the closure member and the spout). In other embodiments, a vacuum (or suction) device may be employed to grasp and selectively retain a portion of the flexible bag, the spout or the closure member. Indeed, the invention is not limited to the grasping of any particular feature or combination of features by the container grasping assembly.

Second arm 72 includes first end 74*b* and second end 76*b*. First end 74*b* includes first arm pivot axis 78*b*. First arm pivot axis 78*b* is substantially vertical. Second end 76*b* extends away from pivot axis 78*b* and includes container grasping assembly 80*b*.

Container grasping assembly 80*b* is shown in FIG. 2 as comprising first jaw 102*b* and second jaw assembly 104*b*. First jaw 102*b* is stationary relative to second end 76*b* of second arm 72. The first jaw 102*b* includes spout receiving region 106*b* which is configured in a shape mating configuration relative to a spout such that a portion of the spout (generally between flanges) can be readily accepted into the spout receiving region. In the embodiment shown, the spout receiving region of the first jaw is vertically offset from second arm 72 such that the Second arm 72 is spaced away from the output of the flexible container forming assembly 12 and input of the flexible container filling assembly 14, to minimize interference therewith. In the present embodiment, the second jaw is positioned below the arm such that the arm is well above the output and input of the respective flexible container forming assembly and the flexible container filling assembly.

Second jaw assembly 104*b* includes second jaw 107*b* and means 109*b* for pivoting the second jaw relative to pivoting axis 108*b*. Second jaw 107*b* includes spout receiving region 106*b*' which is configured in a shape mating configuration relative to a spout. More specifically, second jaw 107*b* is rotatably coupled at pivoting axis 108*b*. Pivoting means 109*b*, in this embodiment, air cylinder 113*b*, is capable of rotating the second jaw relative to the pivoting axis 108*b* from a first position (represented by the phantom view of the second jaw) to a second position (represented by the solid representation of the second jaw). In a first position, the second jaw 107*b* is rotated away from first jaw 102*b*. In a second position, second jaw 107*b* is rotated toward first jaw 102*b* and positioned such that the spout receiving regions 106*b*, 106*b*' are in a position to releasably retain a spout therebetween. The first position rotates the second jaw 107*b* a distance sufficient so as to freely permit the passage of a spout between the first and second jaws. In the embodiment shown, the jaws are configured such that they grasp the sides of the spout relative to the direction of travel of the flexible container out of the flexible container forming assembly. As with the first container grasping assembly 80*a*, container grasping assembly 80*b* is not limited to the grasping of any particular feature of the flexible container.

Figures 4A, 4B, 4C, 4D, 4E:
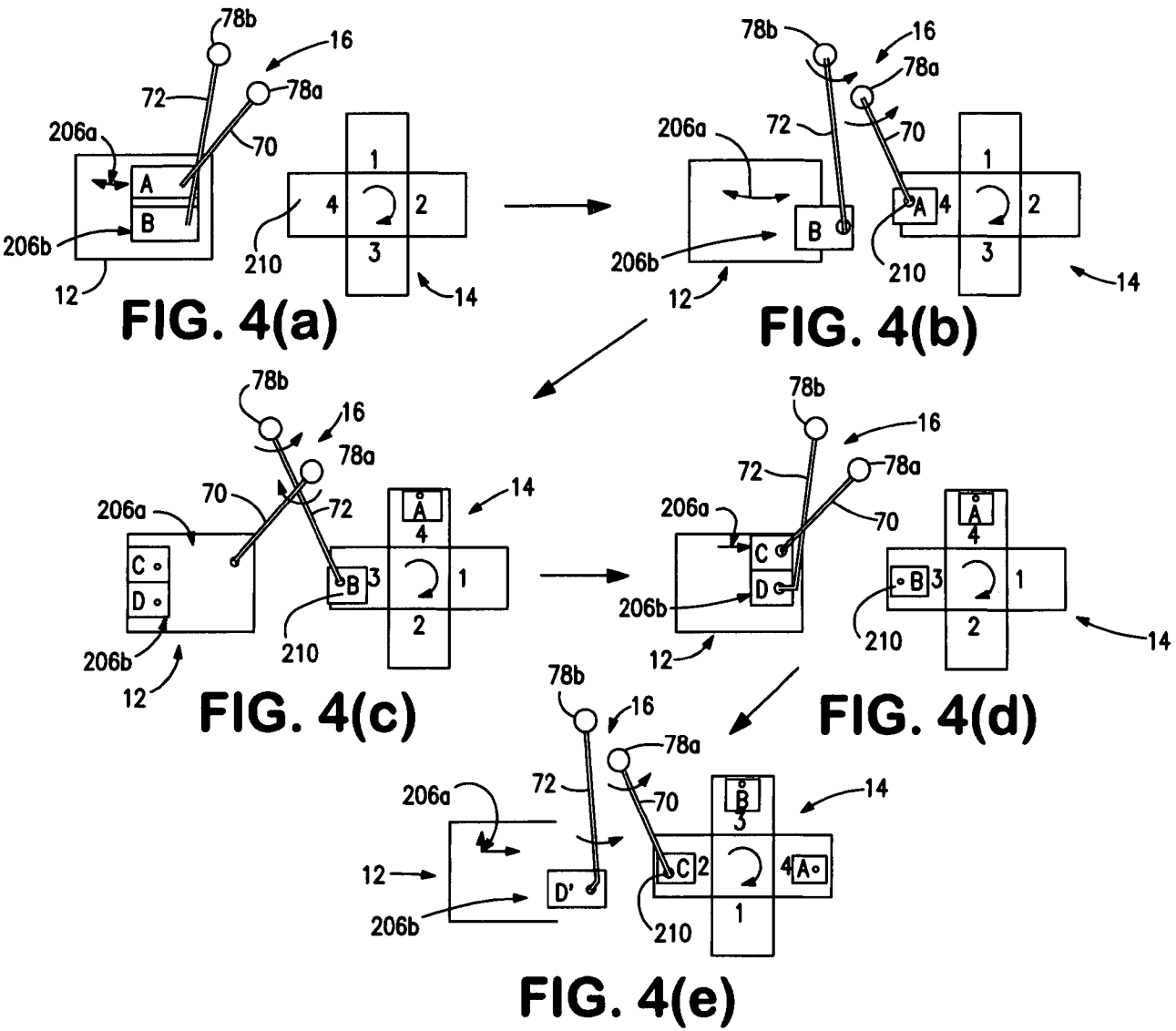
FIG. 4 of the drawings comprises a schematic representation of the operation of the first and second arms of the transfer assembly as successive flexible containers are transferred from the bag forming assembly to the bag filling assembly.

With reference to FIGS. 3 and 4, first arm 70 is pivotable between a first position and a second position. The first position shown in representation (a) of FIG. 4 is proximate the output 206*a* of the flexible container forming assembly so as to receive and retain a spout from a flexible container exiting from the flexible container assembly. The second position shown in representation (b) of FIG. 4 corresponds to the entry position of the flexible container filling assembly. In the second position, first gripper assembly meets the gripping assembly of the flexible container filling assembly at the receiving region 210.

Similarly, with reference to FIGS. 3 and 4, second arm 72 is likewise pivotable between a first position and a second position. The first position shown in representation (a) of FIG. 4 is proximate the output 206*b* of the flexible container forming assembly so as to receive and retain a spout from a flexible container exiting from the flexible container assembly. The second position shown in representation (c) of FIG. 4 corresponds to the entry position of the flexible container filling assembly. In the second position, the second container grasping assembly meets the gripping assembly of the flexible container filling assembly at receiving region 210.

As is shown schematically in FIG. 4, first arm 70 is configured to grasp and move successive flexible containers corresponding to the inner of the two flexible containers which are formed side by side (i.e., from output 206*a* to receiving region 210). The second arm 72 is longer than the first arm 70 and is configured to grasp and move successive flexible containers corresponding to the outer of the two flexible containers which are formed in parallel (i.e., from output 206*b* to receiving region 210). As such, the first position of the first arm and the first position of the second arm are spaced apart from each other a predetermined distance. However, in the second position, the container grasping assemblies 80*a* and 80*b* are in substantially the same position, namely receiving region 210.

Interestingly, without substantially altering the transfer assembly, containers of substantially different volumes (i.e., differences in length) can be accommodated as long as the spatial position and of the spouts is maintained (i.e., the distance between the respective spouts). The other stations can be moved relative to each other and the seals can be altered so as to modify the volume of the container. However, the transfer will not require spatial reconfiguration unless the respective position of the spouts is altered.

In operation, a flexible container is first formed. In particular, and with reference to FIG. 1, rollers 30 in combination with guiding means 32 direct the upper web from roller 200 through the spout attachment assembly. Film spout opening cutting assembly 40 cuts an opening for attachment of the spout. Next, the spout handling and positioning assembly positions the spout relative to the opening in preparation of attachment thereto. Next, the spout is sealed to the film by spout sealing assembly 44. In certain embodiments, the film spout opening cutting assembly can be removed wherein the spout is attached to the film without first forming the opening. It will be understood that in the present embodiment, as two containers are formed side by side, the film spout opening cutting assembly 40 cuts two holes in the film and the spout sealing assembly seals two spouts which are positioned by the spout handling and positioning assembly. A closure member may be coupled to the spout.

Once the spouts have been properly attached, the webs are joined together to form the flexible container in the flexible container sealing assembly. In particular, the upper and lower plates 60, 62 of the flexible container sealing assembly form heat seals so as to define two separate flexible containers, each having a cavity which is accessible by way of the spout.

As each pair of the flexible containers are completed, they are separated from the web and from each other. In particular, the longitudinal cutter separates the pairs of flexible containers from the immediately adjoining pair of flexible containers. The transverse cutter 68 separates the two flexible containers, formed substantially simultaneously, from each other. In certain embodiments, these flexible containers can be separated at other times during the formation. For example, the flexible containers can be separated during the operation (or before the operation) of the flexible container sealing assembly. In still other embodiments, the flexible containers can be separated at other desired locations during the formation process.

The inner container 204*a* is grasped by first arm 70 of container grasping assembly 80*a* at output 206*a*. Specifically, the flexible container is moved and/or the arm is moved such that the spout is positioned between first jaw 102*a* and second jaw assembly 104*a*. Once properly positioned, the second jaw assembly 104*a* is moved and the spout is retained by first arm 70 between the shape mating spout receiving regions 106*a*, 106*a*'. In the embodiment contemplated, the first and second jaws engage the spout between flanges positioned in a spaced apart orientation on said spout.

Outer bag 204*b* is grasped by second arm 72 of container grasping assembly 80*b* at output 206*b*. Specifically, the flexible container is moved and/or the arm is moved such that the spout is positioned between first jaw 102*b* and second jaw 104*b*. Once properly positioned, the second jaw assembly 104*b* is moved and the spout is retained by second arm 72 between the shape mating spout receiving regions 106*b*, 106*b*'. In the embodiment contemplated, as with the first arm, the first and second jaws engage the spout between flanges positioned in a spaced apart orientation on said spout.

As is shown in FIG. 4, sequentially, the first or the second arm is then pivoted from this first position to a second position. In the embodiment shown, the first arm rotates about pivot axis 78*a* from a first position (i.e. output 206*a*) to a second position corresponding to a receiving region 210 wherein the jaws transfer the flexible container to the flexible container filling assembly. As the flexible container is grasped by the flexible container filling assembly, the container grasping assembly of the respective arm release and the flexible container has been transferred to the flexible container filling assembly. The first arm then returns to the first position.

As the first arm is completing the above-described cycle, the second arm, grasping the outer flexible container 204*b*, begins to pivot from the first position (i.e., output 206*b*) to the second position (i.e., receiving region 210). The second arm positions the spout of outer flexible container 204*b* at the receiving region 210 as the first arm is moving back to the first position and as the filler has rotated. As with the other arm, the flexible container is grasped by the flexible container filling assembly, and, the container grasping assembly of the respective arm release and the flexible container is transferred to the flexible container filling assembly. The respective arm returns to the first position.

As is shown in FIG. 4, with particular reference to representation (e), the cycle is repeated as the rotating filler continues to rotate to sequentially transfer flexible containers formed by the flexible container forming assembly at output 206*a*, 206*b* to the flexible container filling assembly at receiving region 210.

Figure 5:
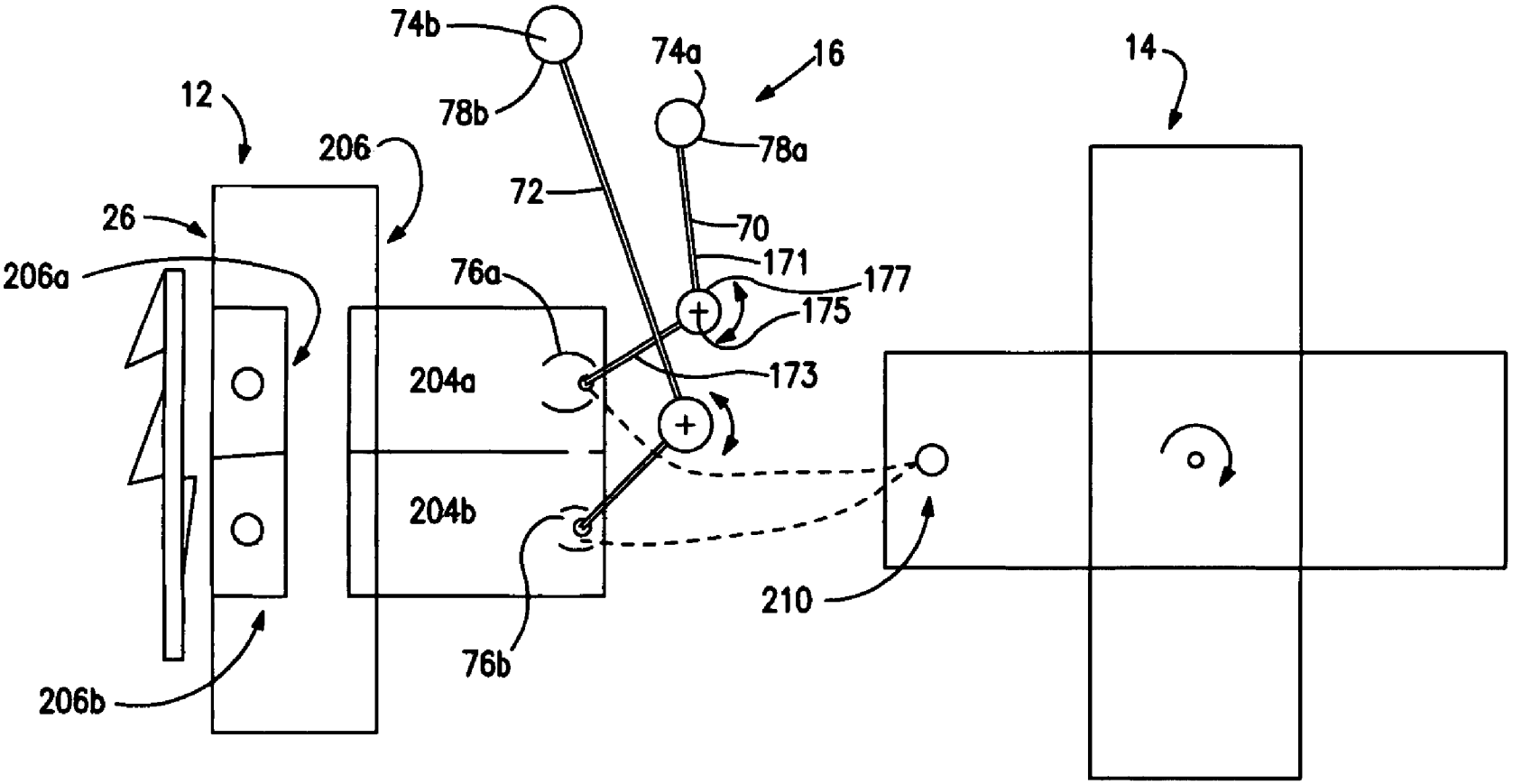
FIG. 5 of the drawings comprises a schematic representation of another embodiment of the first and second arms of the transfer assembly of the present invention.

In other embodiments, either one or both of the first arm and the second arm may include a configuration wherein the container grasping assembly can rotate or translate relative to the respective arm (i.e., providing additional degrees of freedom). For example, and as is shown in FIG. 5, first arm 70 includes first member 171 and second member 173. Second member 173 is rotatably coupled to first member 171 about axis 175. The rotation of the first member relative to the second member about axis 175 can be controlled by a stepper motor 177 or the like. The second arm may have a similar configuration, however, it is not limited thereto.

Figure 6:
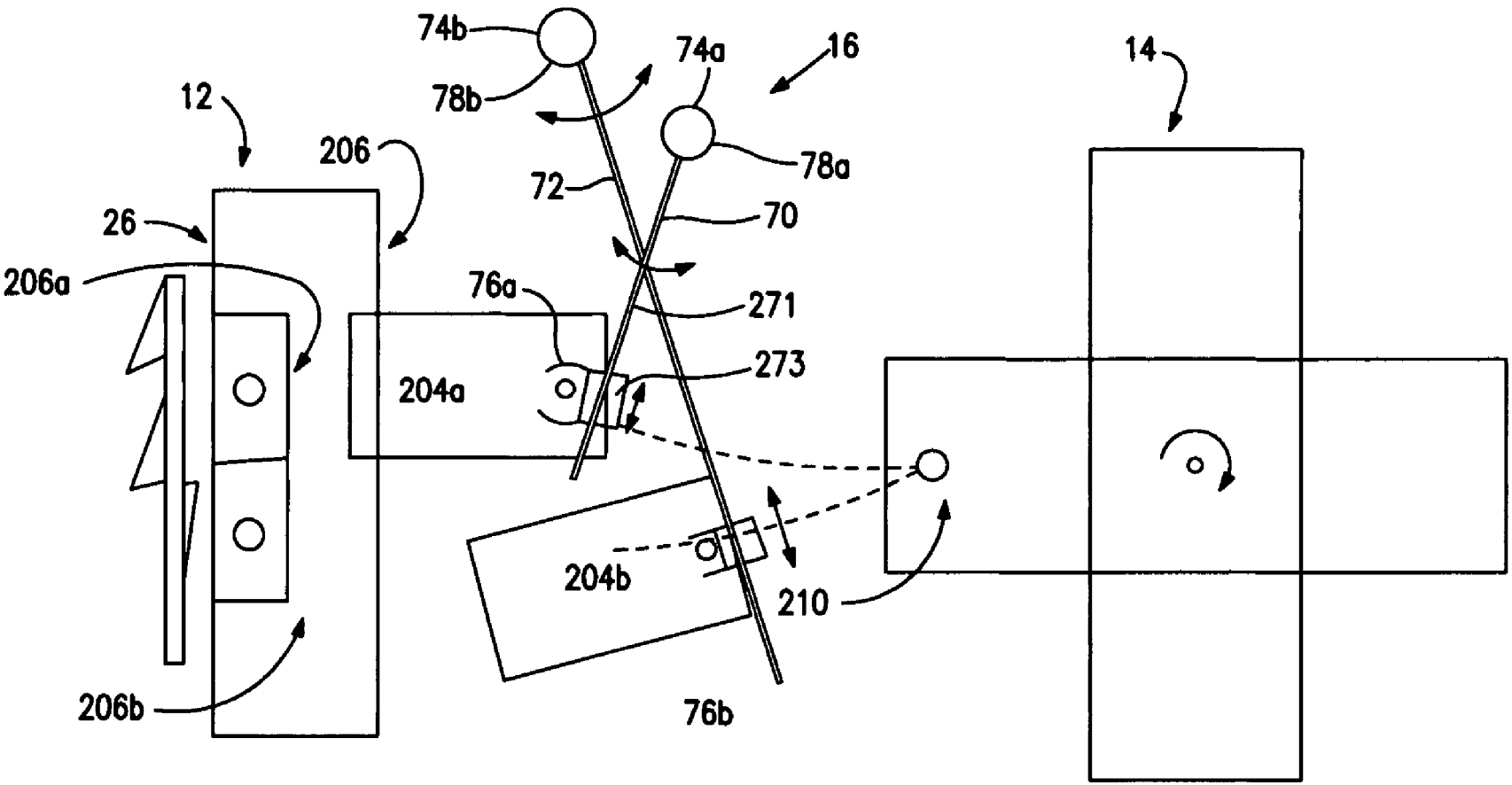
FIG. 6 of the drawings comprises a schematic representation of another embodiment of the first and second arms of the transfer assembly of the present invention.

In another embodiment, as is shown in FIG. 6, first arm 70 may include first member 271 and second member 273. The second member 273 is slidably positionable relative to the first member 271. As such, as the first member rotates about the pivot axis 78*a*, the second member can translate along the first member (which can be controlled by a number of different means (pneumatic, motorized, etc.). In yet another embodiment, as is shown in FIG. 7, second member 273 may comprise much of the length of the first arm, and first member 271 may comprise a member positioned proximate the pivot axis which can slidably translate the second member therethrough, to, in turn, effectively control the length of the second member.

Figure 7:
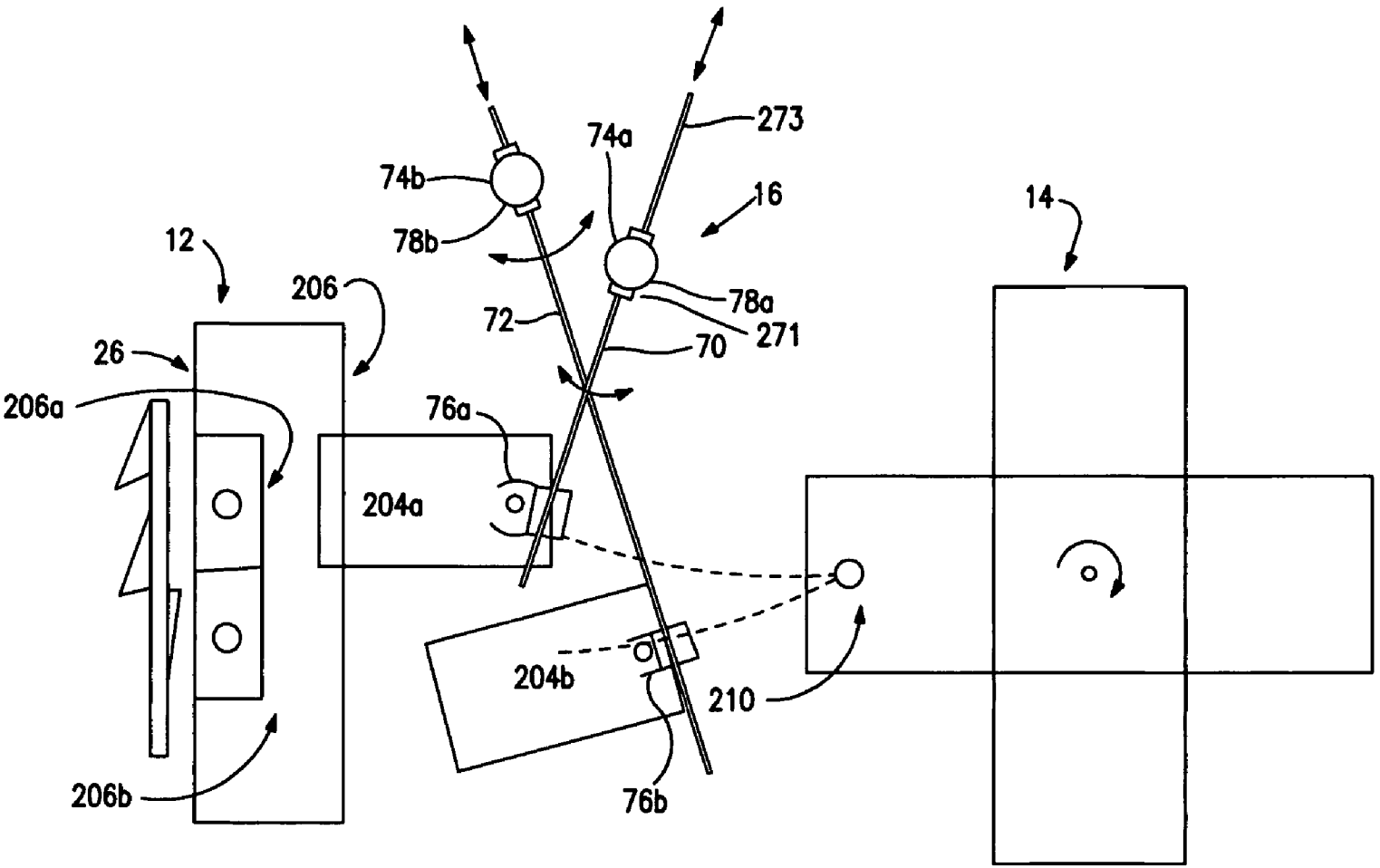
FIG. 7 of the drawings comprises a schematic representation of another embodiment of the first and second arms of the transfer assembly of the present invention.
Figure 8:
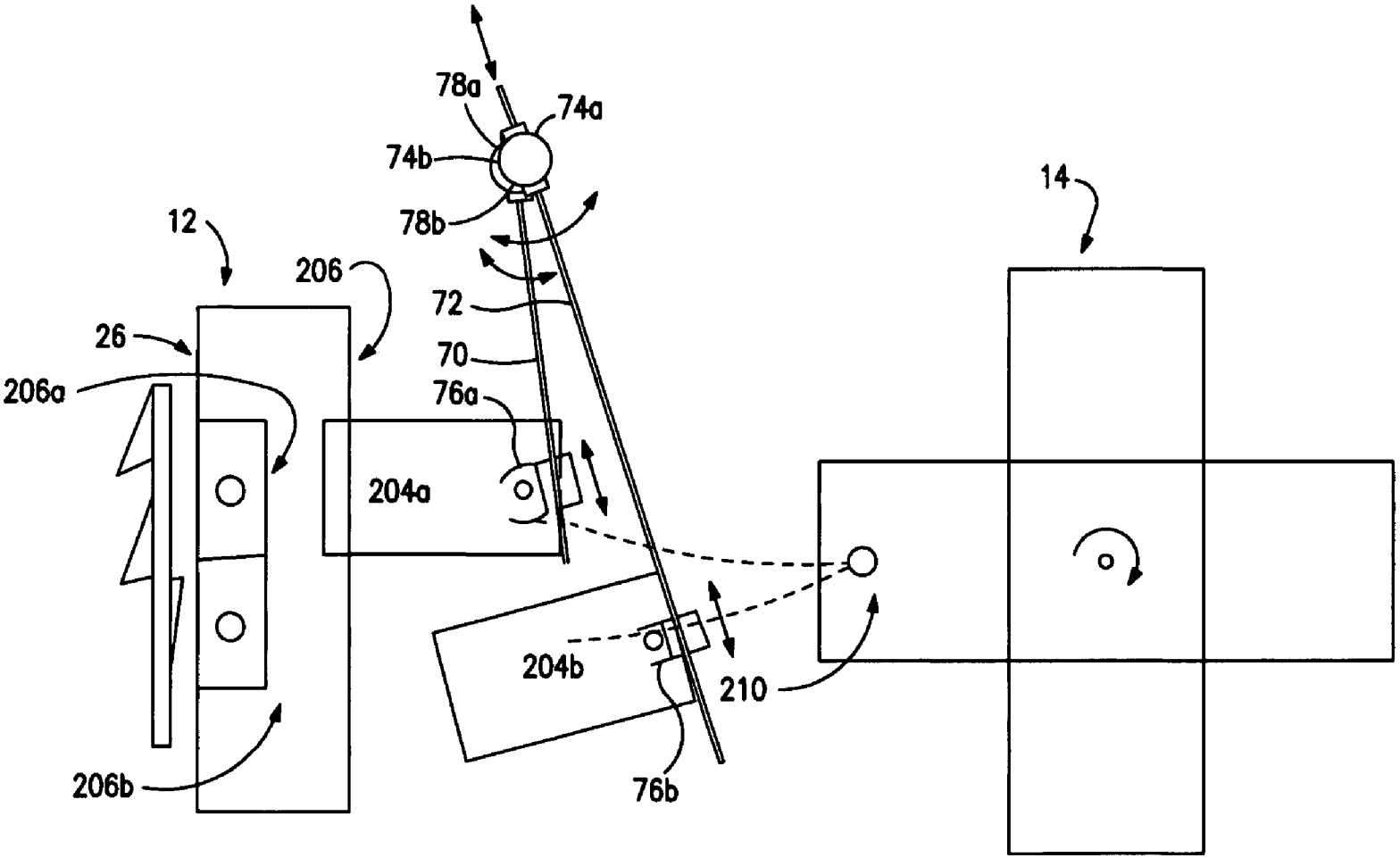
FIG. 8 of the drawings comprises a schematic representation of another embodiment of the first and second arms of the transfer assembly of the present invention.

It will be understood that any one of the different arm configurations shown in FIGS. 5 through 7 can be employed selectively on one or both of the first arm and the second arm. Significantly, wherein the configurations shown in FIGS. 5 through 7 are employed on at least one of the first arm and the second arm, pivot axis 78*a* and pivot axis 78*b* may be identical or may be distinct. For example, an embodiment wherein the pivot axes are distinct is shown in FIG. 7 whereas an embodiment wherein the pivot axes are identical is shown in FIG. 8. It will be understood that the operation of the embodiments shown in FIGS. 5 through 7 are substantially similar to that shown in FIGS. 4*a* through 4*e*, with the exception that the container grasping assembly can move relative to the remainder of the arm, such that the path taken by a flexible container from the container forming assembly to the flexible container filling assembly may be different.

Figure 9:
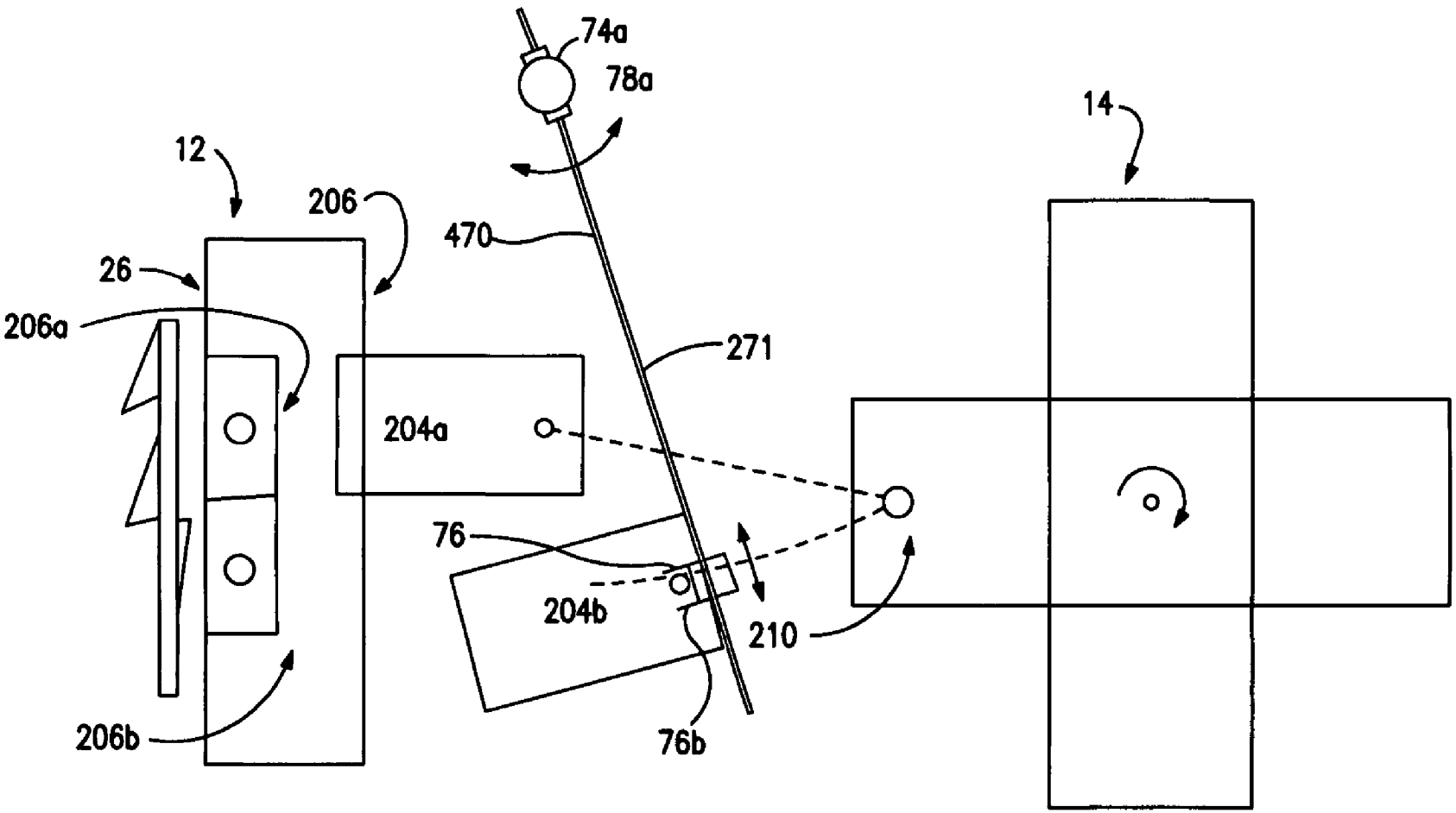
FIG. 9 of the drawings comprises a schematic representation of an embodiment of the transfer assembly utilizing a single arm.

With reference to FIG. 9, a single arm may be employed in transfer assembly 16. In such an embodiment, arm 470 employs one of the arm configurations shown in FIGS. 5 through 7 and rotates so as to alternatively grasp finished flexible containers from one of the two side by side feeds. It will be understood that the single arm generally makes two trips in the time that it takes for each arm of a two arm embodiment to make a single trip.

Advantageously, as the flexible container forming assembly requires a stepped process (i.e., a stoppage necessary to seal the spout to the web and to form the seals that define the cavities), which is generally slower than the rate with which the filler is capable of filling flexible containers, the forming of multiple flexible containers at the same time then transferred by a transfer assembly to the same filler allows the assembly to harness the increased speed capability of the filler device. Furthermore, it is advantageous that in the preferred embodiment, multiple flexible containers can be formed in the same flexible container forming assembly at the same time then transferred sequentially to the same filler device.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A flexible container forming and filling apparatus comprising:

a flexible container forming assembly configured for forming at least two side by aide flexible containers which define at least a first output and a second output;

a flexible container filling assembly associated with the flexible container forming assembly having a receiving region configured for receipt of sequential flexible containers for filling; and a transfer assembly configured for sequentially transferring flexible containers from the first output to the receiving region of the flexible container filling assembly and from the second output to the receiving region of the flexible container filling assembly, wherein the transfer assembly comprises:

a first arm pivoting about a first pivot axis having:

a first end, a second end, and, a first container grasping assembly associated with the second end of the first arm; and a second arm pivoting about a second pivot axis having:

a first end, a second end, and a second container grasping assembly associated with the second end of the second arm, wherein the first arm pivots between a first position corresponding to the first output and a second position corresponding to the receiving region and the second arm pivots between a first position corresponding to the second output and a second position corresponding to the receiving region.

2. The flexible container forming and filling apparatus of claim 1 wherein the first container grasping assembly and the second container grasping assembly each comprise:

a first jaw having a first spout receiving region;

a second jaw having a second spout receiving region, the second jaw pivoting about a pivot axis and including means for pivoting the second jaw about the pivot axis.

3. The flexible container forming and filling apparatus of claim 1 wherein the first pivot axis is spaced apart from the second pivot axis.

4. The flexible container forming and filling apparatus of claim 1 wherein at least one of the first arm and the second arm comprises a first member and a second member wherein the respective container grasping assembly is coupled to the second member and wherein the second member is at least one of slidably and rotatably coupled to the first member.

5. The flexible container forming and filling apparatus of claim 4 wherein each of the first arm and the second arm include a first member and a second member.

6. The flexible container forming and filling apparatus of claim 4 wherein the first pivot axis and the second pivot axis comprise the same pivot axis.

7. The flexible container forming and filling apparatus of claim 4 wherein the first pivot axis is spaced apart from the second pivot axis.

8. A flexible container forming and filling apparatus comprising:

a flexible container forming assembly configured for forming at least two side by side flexible containers which define at least a first output and a second output;

a flexible container filling assembly associated with the flexible container forming assembly having a receiving region configured for receipt of sequential flexible containers for filling; and a transfer assembly configured for sequentially transferring flexible containers from the first output to the receiving region of the flexible container filling assembly and from the second output to the receiving region of the flexible container filling assembly, wherein the transfer assembly comprises:

a first arm having a first member and a second member, a container grasping assembly associated with the second member, wherein the first and second members are at least one of slidably and rotatably coupled to each other, and wherein the container grasping assembly is positionable between the first output and the receiving region and the second output and the receiving region.

9. The flexible container forming and filling apparatus of claim 8 wherein the container grasping assembly comprises:

a first jaw assembly having a first spout receiving region;

a second jaw assembly having a second spout receiving region, the second jaw assembly pivoting about a pivot axis and including means for pivoting the second jaw about the pivot axis.

10. The flexible container forming and filling apparatus of claim 8 wherein the flexible container forming assembly further comprises:

a film supply subassembly;

spout attachment assembly positioned downstream of the film supply subassembly;

a flexible container sealing assembly positioned downstream of the spout attachment assembly; and a cutting assembly positioned downstream of the film supply subassembly.

11. The flexible container forming and filling apparatus of claim 8 wherein the flexible container filling assembly comprises a rotary filler.

* * * * *